United States Patent [19]

Zehnal

[11] Patent Number: 4,944,406

[45] Date of Patent: Jul. 31, 1990

[54] CARTON WITH POUR SPOUT

[75] Inventor: Sally A. Zehnal, Houston, Tex.

[73] Assignee: Uncle Ben's Inc., Houston, Tex.

[21] Appl. No.: 244,136

[22] Filed: Sep. 14, 1988

[51] Int. Cl.[5] ..... B65D 5/70

[52] U.S. Cl. ..... 206/621.4; 206/626; 206/628

[58] Field of Search ..... 206/621.4, 621.6, 626, 206/628, 631.2

[56] References Cited

U.S. PATENT DOCUMENTS

| | | | |
|---|---|---|---|
| 2,819,831 | 1/1958 | Polarek et al. | 206/626 |
| 3,203,615 | 8/1965 | Moore | 206/626 |
| 3,203,616 | 8/1965 | Bolton et al. | 206/626 |
| 3,549,079 | 12/1970 | Northrup | 206/631.2 |
| 3,971,506 | 7/1976 | Roenna | 206/626 |
| 4,317,518 | 3/1982 | Mode | 206/626 |
| 4,809,853 | 3/1989 | Weber | 206/621.6 |

FOREIGN PATENT DOCUMENTS

| | | | |
|---|---|---|---|
| 639340 | 11/1983 | Switzerland | 206/626 |
| 2045723 | 11/1980 | United Kingdom | 206/626 |

*Primary Examiner*—Gary Elkins

*Attorney, Agent, or Firm*—Curtis, Morris & Safford

[57] ABSTRACT

A carton with a pour spout having top, bottom, front, back, and two side portions, wherein one of the side portions has a pour spout therein. The pour spout has a pull tab connected to an orifice cover at a hinge line. The orifice cover is connected to the side of the carton at a second hinge line. The orifice, located directly behind the orifice cover, has a trough-shaped bottom. The pour spout is re-closable by inserting the pull tab through the orifice, back inside the carton. A re-open notch is provided for easy re-opening of the pour spout.

32 Claims, 3 Drawing Sheets

FIG. 3
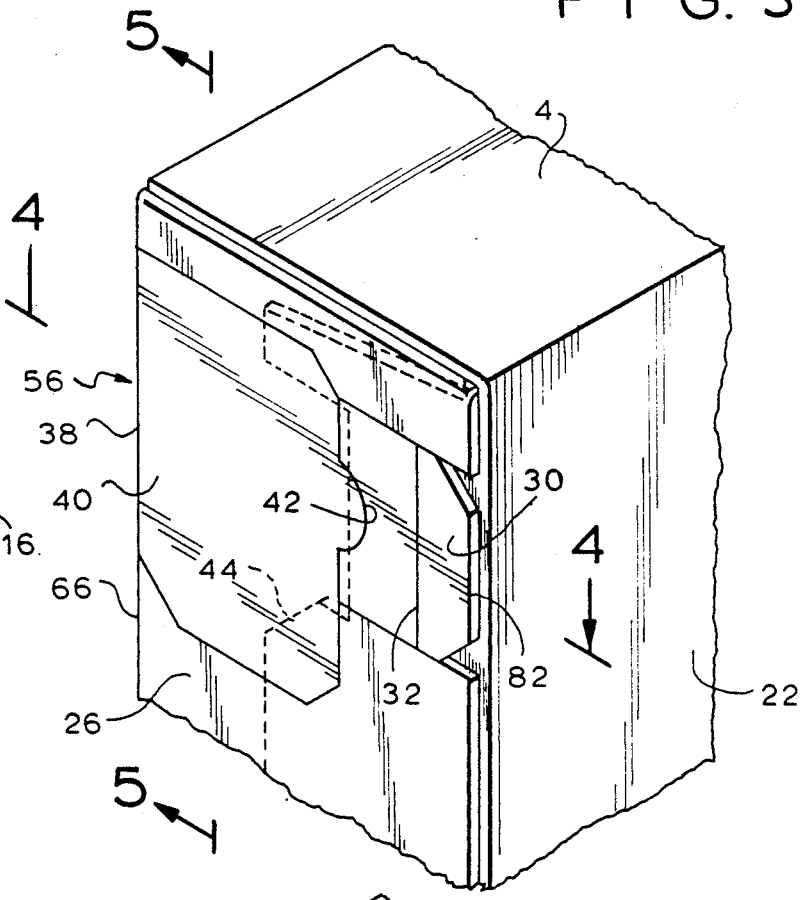
FIG. 5
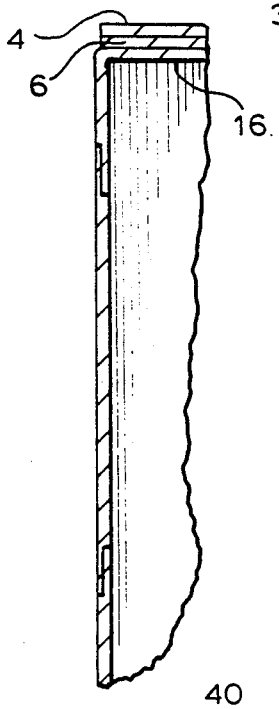
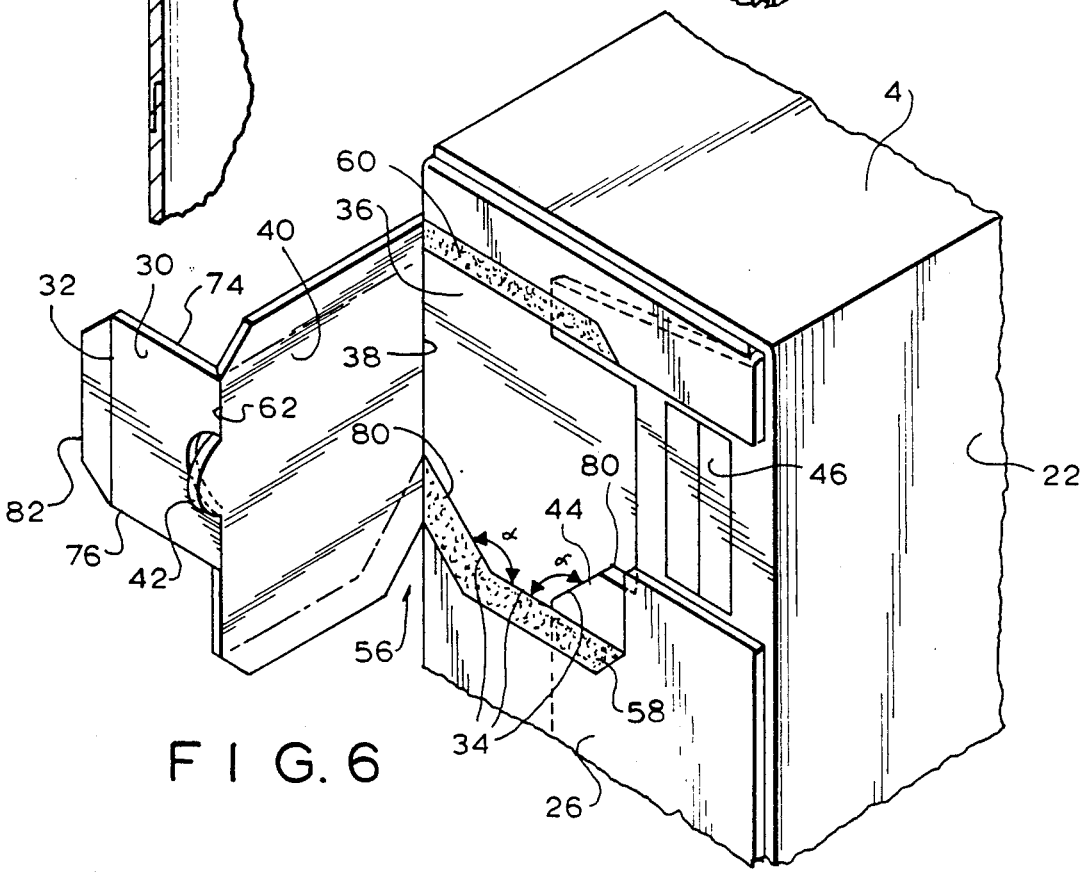
FIG. 6

CARTON WITH POUR SPOUT

BACKGROUND OF THE INVENTION

1. Field of the Invention

The instant invention relates generally to cartons for holding pourable or flowable materials and more particularly to such cartons having pour spouts therein.

2. Description of the Prior Art

Containers for pourable materials are frequently supplied to manufacturers in the form of appropriately shaped blanks of sheet packaging material. These containers are assembled at a packaging point, filled with the desired pourable material and then sealed. Such containers are generally employed where the contents of the container are not likely to be used at one time.

Various types of cartons having pour spouts are known in the art. (e.g. U.S. Pat. Nos. 4,684,058, 4,546,884, 4,362,245 and 4,327,833). Some cartons have pour spouts formed by a flap-cut or perforation in the carton wall. (e.g. U.S. Pat. Nos. 2,218,670, 2,555,526, 2,661,138, 2,719,663, 2,820,581, 3,203,616, 3,266,055 and 4,015,768). Other cartons have pour spouts which have pre-cut openings in a panel folded underneath which are covered with a tear-away flap. (e.g. U.S. Pat. Nos. 1,491,518 and 3,199,761). Many of these cartons provide some means for re-closing the pour spout. None, however, has provided to the consumer, the ease of opening, re-closure, and re-opening of the pour spout of the present invention.

OBJECTS OF THE INVENTION

A primary object of the present invention is to provide a carton with a pour spout which permits better flowability of the material contained within the carton than prior art designs.

Another object is to provide a carton having a pour spout which is more easily opened on the initial pull than prior art designs.

An additional object is to provide a carton with a pour spout in which the pour spout has a tight-fitting reseal position.

A still further object is to provide a carton having a pour spout which is easily re-opened.

The further objects of the invention will become clear as the description proceeds.

SUMMARY OF THE INVENTION

The present invention is directed to a carton having a pour spout designed to increase the outward flowability of the substantially pourable material contained therein. The carton is formed from a modified carton blank. It is comprised of top and bottom inner and outer flaps, bottom left and right side inner flaps, a front side portion, a back side portion, a left side portion, a right side outer flap portion and a right side inner glue flap portion.

The pour spout is comprised of a pull tab connected to an orifice cover which has a re-open tab extending therefrom. The orifice cover overlies the pouring orifice which has a generally trough-shaped bottom. More specifically, the orifice has a bottom with a substantially flat base portion with a side portion extending outwardly from each end of the base portion at a substantially oblique angle. (This trough shape allows better flowability of the material out of the carton by providing a funnelling effect. This shape also gives the user more control of the material exiting the carton by directing the material toward the middle of the pouring orifice, and hence, the appropriate area of the target.) The pull tab may also have a bend score line spaced slightly away from the leading edge of the pull tab. This bend score line, if employed, is located immediatley prior to a glue area which is used to hold the pull tab in place.

In use, the blank is assembled by first gluing the right side inner glue flap portion to the right side outer flap side portion. (The glue flap does not completely overlap the right side outer flap. Instead it ranges from 30 to 70% of the width of the right side outer flap. This minimizes the amount of packaging material needed to make the carton of this invention.) Next, the bottom (or the top) of the carton is sealed. The bottom (or the top) right and left side inner flaps are bent inwardly along their respective score lines. The bottom inner flap is then bent inwardly along its score line and lastly, the bottom outer flap is bent inwardly along its score line and secured with glue to the bottom inner flap. The carton is then filled with pourable material and the top (or the bottom) of the carton sealed in the same manner as the bottom. The pour spout is closed in place when the inner glue flap portion is glued to the right side outer flap portion.

To dispense material from the pour spout the pull tab is lifted away from the right side inner glue flap portion. The pull tab, which is connected to the orifice cover, pulls the orifice cover away from the right side outer flap portion to which it is secured by cut scores along its top and bottom edges. These cut scores are typically cut at 30–70% of the packaging material thickness. The pull tab bends at a line located at the beginning of the orifice cover which straddles the re-open notch (this line may be a bend score line, if desired). The orifice cover itself bends along a hinge line that is contiguous with the bend score line between the front side portion and the right side outer flap portion. The displacement of the orifice cover away from the right side outer flap portion exposes the pouring orifice and its corresponding trough-shaped bottom. The pouring orifice is defined by cuts in the right side outer flap portion and the right side inner glue flap portion. The right side of the pouring orifice including the right side angle portion of the trough are directly formed by the inner glue flap portion when it is glued to the right side outer flap portion.

To re-close the orifice cover, the pull tab is bent inwardly to an angle of 90° or less to the orifice cover. It is then inserted into the orifice itself and the orifice cover is pushed until its top and bottom cut score portions abut the right side outer flap portion. Once inserted, the pull tab rests on a small ledge formed by the right side inner glue flap portion.

To re-open the pour spout, the re-open notch, which is integral with and extends outwardly from the orifice cover, is pulled outwardly. As before, the orifice cover moves outwardly and bends along the hinge line. The cover is opened an amount sufficient to allow pourable material within the carton to be poured out in a manner unimpeded by the pour spout. (This position is generally achieved only after the pull-tab has been totally withdrawn from within the carton and has been bent outwardly.) The pour spout may be re-opened and re-closed indefinitely until the entire contents of the carton have been removed.

BRIEF DESCRIPTION OF THE DRAWINGS

FIG. 3 is an enlarged fragmentary perspective view of the pour spout of the present invention in its initial sealed position.

FIG. 5 is an enlarged fragmentary sectional view taken along line 5—5 of FIG. 3.

FIG. 6 is an enlarged fragmentary perspective view of the pour spout of the present invention in its open position.

DESCRIPTION OF THE PREFERRED EMBODIMENTS

Figure 1:
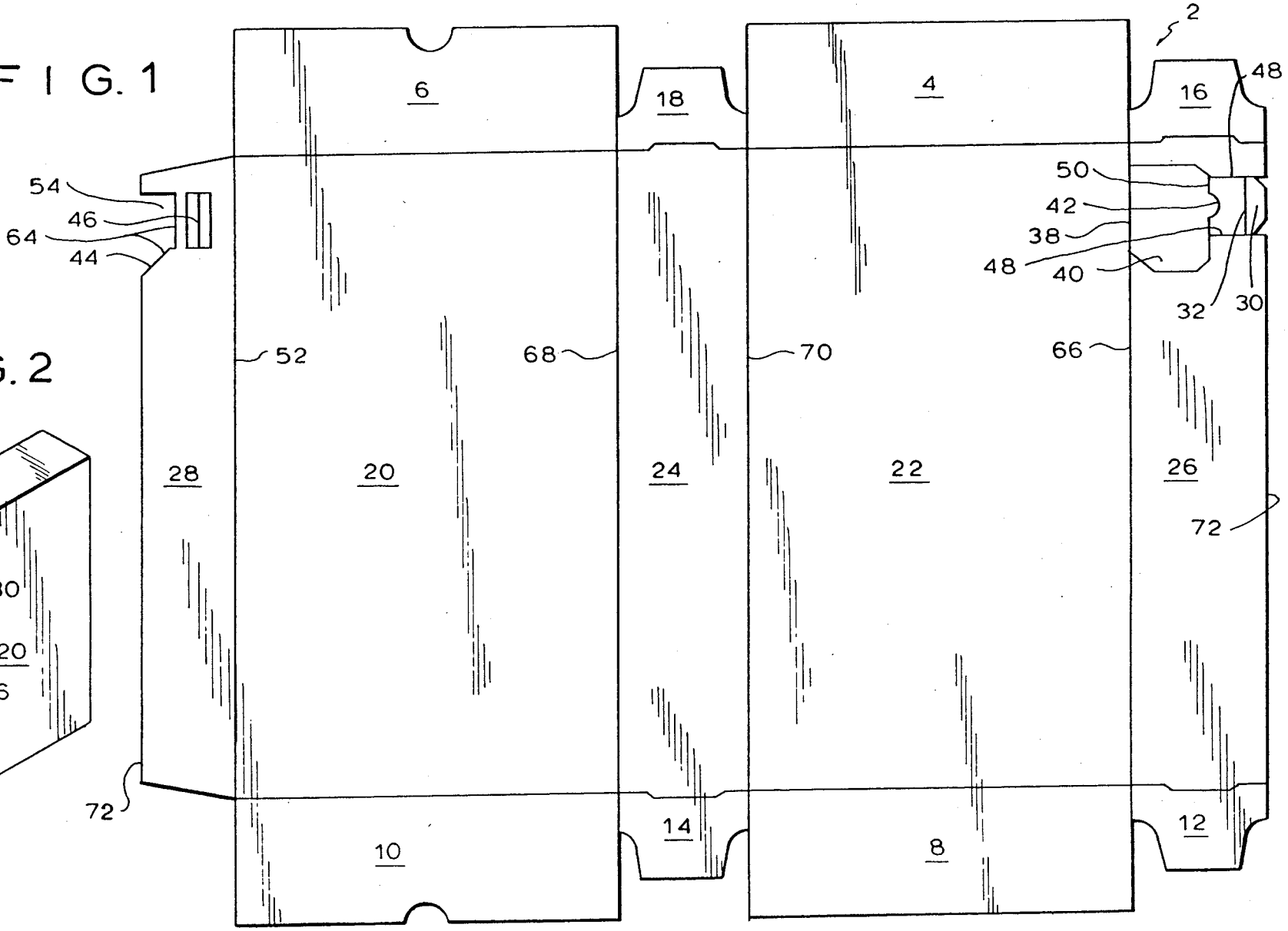
FIG. 1 is a top, plan view of a blank die cut which forms a carton in accordance with the present invention.

Referring now more particularly to the drawings, FIG. 1 illustrates a carton 1 of the present invention in a blank, die-cut form. The various lines between the panels generally represent fold or score lines and are the areas along which carton 1 is folded in order to assemble it into finished form.

To assemble the carton, the blank 2 is folded along score lines 66, 68, 70 and 52 with right side outer flap portion 26 covering right side inner glue flap portion 28 such that the free end 72 of the right side outer flap portion 26 is aligned with fold line 52 of the right side inner glue flap portion 28. The right side outer flap portion 26 is glued to the right side inner glue flap portion 28 to form the carton into a substantially rectangular shape. At the same time, the pull tab 32 may be affixed to the right side inner glue flap portion 28 by the placement of glue (not shown) in the glue area 46.

Turning to FIG. 6, the pouring orifice 36 has a trough shaped bottom 34 and squared off sides and top portions. A small ledge 80 is located to the right of the top of trough shaped bottom 34. Specifically, the trough shaped bottom 34 of the pouring orifice 36 has a substantially flat base portion 78 with two side portions 44 and 80 extending outwardly from the end of the base portion 78 at substantially oblique angles$\alpha$. Optimally, the two side portions 44 and 80 extend outwardly at an angle $\alpha$ of 135° from the ends of base portion 78. As shown above in FIG. 1, the pouring orifice 36 is defined by the hole in left side outer flap portion 26 which remains when orifice cover 40 is opened and by a notch 64 in inner glue flap portion 28. The entire right side of pouring orifice 36 is defined by notch 64 including the right side wall 44 of trough 34. (It should be noted that inner glue flap 28 does not have to be the same width as right side outer flap portion 26. It can range from as little as 30% of the right side flap portion's width to as much as 70%.)

By way of example, the top of orifice cover 40 and cut score 60 are located 0.25 inches from the top of the carton 1. The width of the pouring orifice 36 and orifice cover 40 is 0.75 inches. The depth of the trough 34 is 0.25 inches while the height of the orifice 36 above the trough 34 is 0.625 inches. The flat base portion 78 of trough 34 is 0.1875 inches while the width of each side 44 and of trough 34 is 0.25 inches. The ledge 80 is 0.0625 inches wide.

In order to properly fill the carton 1 and retain the pourable product (not shown) therein, it is necessary to seal the bottom (or top) of the carton 1. This is done by first folding the bottom right side inner flap 12 and the bottom left side inner flap 14 inwardly. The bottom inner flap 8 is then folded over the right and left side inner flaps 12 and 14 and then affixed to the bottom outer flap 10 which is folded over bottom inner flap 8. A pourable material (not shown) such as liquid, rice, cereal, etc. is then placed in the carton 1 and the top (or bottom) of the carton 1 is then closed.

Figure 2:
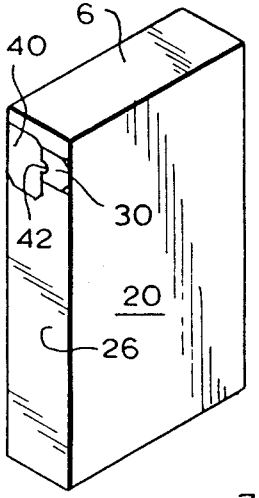
FIG. 2 is a rear perspective view of a container formed from the blank of FIG. 1 with the pour spout in the initial closed and sealed position.
Figure 4:
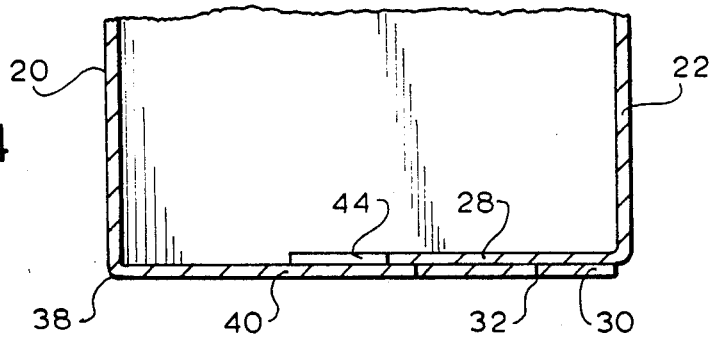
FIG. 4 is an enlarged fragmentary sectional view taken along line 4—4 of FIG. 3.

The top is closed by first folding the top right side inner flap 16 and the top left side inner flap 18 inwardly. The top inner flap 4 is folded over the right and left side inner flaps 16 and 18 which in turn is then affixed to the top outer flap 6 which is folded over that, thereby sealing the container. A completely assembled carton 1 of the present invention is shown in FIG. 2. The appearance of the pour spout assembly 56 in its initial sealed position is shown in FIGS. 3 and 4.

In use, the pull tab 30 is initially lifted away from inner glue flap 28. This pulling away is assisted by the cut score of glue area 46 such that when outward pressure is applied to pull tab 30, approximately 30–70% of the packaging material in glue area 46 is pulled away. The 30–70% of the packaging material which is pulled away is affixed to pull tab 30 by the glue placed in the glue area 46 (behind pull tab 30) in assembly of carton 1. The user's ability to raise the pull tab 30 may be assisted by placing a bend score line 32 just slightly behind the end of pull tab 30 and just before glue area 46. This allows the glue-free front portion of pull tab 30 to be raised and more firmly grasped prior to applying the necessary outward pressure to glue area 46 to free pull tab 30.

Pull tab 30 is directly connected to orifice cover 40 at line 62 which straddles re-open tab 42. (Line 62 may be a bend score line if desired). Thus, after pull tab 30 is free from glue area 46, continued pressure on pull tab 30, will pull orifice cover 40 away from left side outer flap portion 26 at cut scores 58 and 60 (shown in cross-sectional detail in FIG. 5). As orifice cover 40 is pulled away from right side outer flap portion 26 it pivots about opening hinge line 38 which is contiguous with right side carton bending line 66. In order to pour material out from within the carton 1, orifice cover 40 is pulled away from pouring orifice 36 a sufficient amount to permit free egress of the contents. (See FIG. 6).

Figure 7:
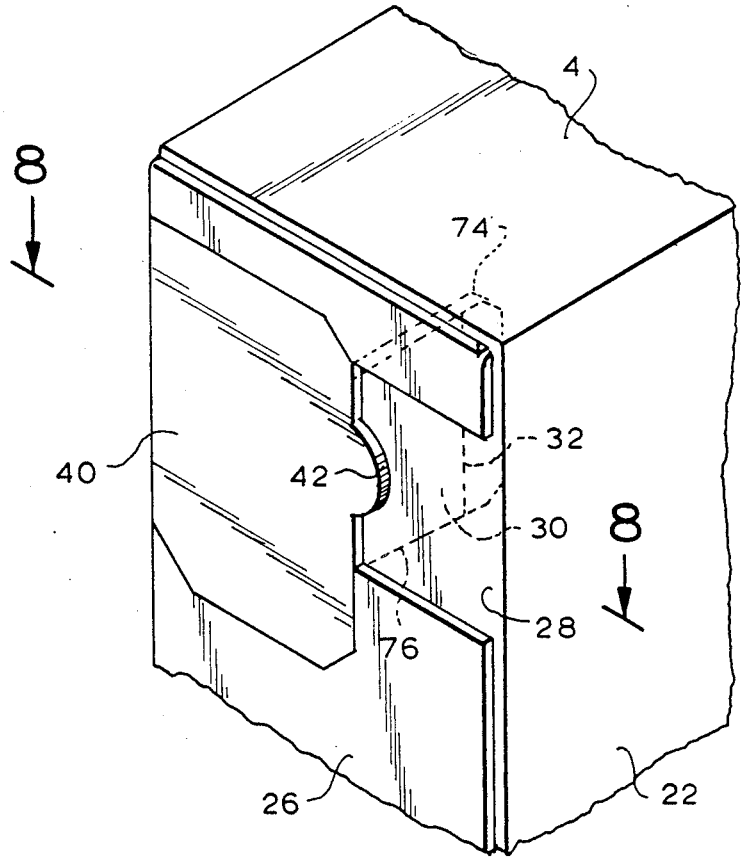
FIG. 7 is an enlarged fragmentary perspective view of the pour spout of the present invention in its re-closed position.
Figure 8:
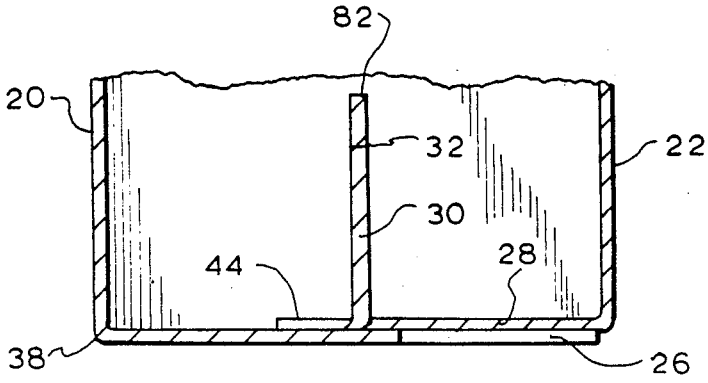
FIG. 8 is an enlarged fragmentary sectional view taken along line 8—8 of FIG. 7.

Re-closure is effected by pivoting pull tab 30 inwardly about bend score line 62 until pull tab 30 forms an an angle 90° or less with respect to orifice cover 40. Pull tab 30 has an upper edge 74 and lower edge 76 which abut the top of orifice 36 and ledge 80 respectively as pull tab 30 is slidably inserted into carton 1 through pouring orifice 36. Orifice cover 40 is pushed inwardly until it again abuts cut scores 58 and 60. At this point re-open notch 42 is also in abutting relation to inner glue flap 28 and pull tab 30 is supported by ledge 80 on lower edge 76. These relationships prevent push-through of orifice cover 40. When these relationships exist, carton 1 is essentially re-sealed. (See FIGS. 7 and 8).

Re-opening is effected by pulling or pushing outwardly on re-open tab 42 which is preferably of arcuate shape. This causes orifice cover 40 to pivot about opening hinge 38 and withdraws pull tab 30 from within the confines of the carton 1. When pull tab 30 is completely free from within carton 1, it may be grasped and bent outwardly so that it does not impede the outward flow of the pourable materials within the carton 1. This process may be repeated indefinitely until the entire contents of carton 1 have been removed.

The pour spout 56 of the present invention may be employed on any size carton. Preferably, the size of the pour spout 56 is limited to the dimensions given in the example, regardless of the carton size. When a pour spout of this size is used with a large carton such that the free end 82 of pull tab 30 is located away from the edge of right side outer flap portion 26, a notch may be cut in the right side outer flap portion 26 to permit finger access to pull tab 30.

Although the present invention has been described with reference to a specific embodiment, it should not be construed as limited to the details disclosed herein as this embodiment is merely illustrative of the invention.

I claim:

1. A blank for forming a carton comprising:

(a) a back portion;

(b) first top and bottom inner flap portions connected to said back portion;

(c) first and second side portions connected to said back portion, said second side portion having:

(1) a pull tab cut therein, said pull tab having at least one free end;

(2) an orifice cover cut therein, said cover connected to said pull tab at a first hinge line and connected to said back portion at a second hinge line; and (3) re-open means integral with said orifice cover;

(d) second top and bottom inner flap portions connected to said first side portion;

(e) third top and bottom inner flap portions connected to said second side portion;

(f) a front portion connected to said first side portion;

(g) top and bottom outer flap portions connected to said front portion; and (h) a glue flap portion connected to said front portion at a bend score line, said glue flap portion having:

(1) a pull tab glue area; and (2) an orifice notch cut therein located near said pull tab glue area.

2. A carton blank according to claim 1, wherein said pull tab includes a bend score line located behind said free end of said pull tab.

3. A carton blank according to claim 2, wherein said orifice cover is removably attached at its top and bottom to said second side portion with a score cut in the range from 30 to 70%.

4. A carton blank according to claim 3, wherein said pull tab glue area has a score cut in the range from 30 to 70%.

5. A carton blank according to claim 4, wherein said re-open means is of arcuate shape.

6. A carton blank according to claim 5, wherein said glue flap portion is of less width than said second side portion.

7. A carton blank according to claim 6, wherein said glue flap portion is in the range of 30% to 70% of the width of said second side portion.

8. A carton blank according to claim 6, wherein said orifice notch has a top side substantially parallel to the top of said second side portion, a right side substantially parallel to said bend score line and a bottom side extending downwardly at an oblique angle to said right side.

9. A pour spout, integral with a carton comprising:

(a) a pull tab having at least one free end, wherein said pull tab includes a bend score line located behind and away from said free end of said pull tab and in front of said glue area;

(b) an orifice cover connected to said pull tab, wherein said orifice cover is releasably attached at its top and bottom portions to said carton by score cuts in the range of 30% to 70%.

(c) a glue area located under said pull tab, in front of said orifice cover and away from said free end of said full tab;

(d) a pour spout orifice immediately beneath said orifice cover, wherein said pour spout orifice has a substantially trough shaped bottom portion;

(e) a re-open tab integral with said orifice cover.

10. A pour spout according to claim 9, wherein said re-open tab is of substantially arcuate shape.

11. A carton with a pour spout for containing a pourable material comprising:

(a) a front portion;

(b) first and second side portions at least in part connected to said front portion, said first side portion having:

(1) an outer flap, said outer flap including:

(i) pull tab means;

(ii) orifice cover means connected to said pull tab means;

(iii) re-open means integral with said orifice cover means;

(2) an inner glue flap;

(c) a back portion, having a top and bottom portion, at least in part connected to said first and second side portions;

(d) a top portion at least in part connected to said first and second side portions and said front and back portions; and (e) a bottom portion at least in part connected to said first and second side portions and said front and back portions.

12. A carton with a pour spout according to claim 11, wherein said first side portion includes a pouring orifice having a substantially trough shaped bottom portion.

13. A carton with a pour spout according to claim 12, wherein said pull tab means has a bend score thereon.

14. A carton with a pour spout according to claim 13, wherein said first side portion further includes a glue area located under said pull tab means and behind said bend score.

15. A carton with a pour spout according to claim 14, wherein said orifice cover is releasably attached at its top and bottom portions to said first side portion by a score cut in the range from 30% to 70%.

16. A carton with a pour spout according to claim 15, wherein said pull tab means is releasably attached to said glue flap.

17. A carton with a pour spout according to claim 16, wherein said pour spout is operable between:

(a) an initial closed position, wherein said pull tab is attached to said glue flap and wherein said orifice cover is attached to said first side portion to confine the pourable material within the carton; and (b) an open position, wherein said pull tab is not attached to said glue flap, and wherein a substantial portion of said pull tab is located on the exterior of said carton, and wherein said orifice cover is not attached to said first side portion such that the pourable material may be discharged from said carton; and (c) a re-closed position, wherein said pull tab is within the interior of said carton, and wherein said orifice cover is not attached to said outer flap portion, and wherein the top and bottom positions of said orifice cover abut said outer flap portion to maintain the pourable material within the carton after the pour spout has been initially opened.

18. A carton with a pour spout according to claim 17, wherein said glue flap has an orifice notch cut therein.

19. A carton with a pour spout according to claim 18, wherein said glue flap portion is of less width than said outer flap portion.

20. A carton with a pour spout according to claim 19, wherein said glue flap portion is in the range of 30% to 70% of the width of said outer flap portion.

21. A carton with a pour spout according to claim 18, wherein said orifice notch has a top side substantially parallel to the top of said outer flap portion, a side substantially perpendicular to the top of said outer flap portion and a bottom extending downwardly at an oblique angle to said right side.

22. A carton of any size with a pour spout comprising:

(a) a front portion;

(b) first and second side portions at least in part connected to said front portion, said first side portion having:

(1) an outer flap, said outer flap including:

(i) pull tab means having a bend score thereon;

(ii) orifice cover means connected to said pull tab means;

(iii) re-open means integral with said orifice cover means;

(2) an inner glue flap of less width than said outer flap portion, said inner flap having an orifice notch cut therein; and (3) a pouring orifice having a substantially trough shaped bottom;

(c) a back portion at least in part connected to said first and second side portions;

(d) a top portion at least in part connected to said first and second side portions and said front and back portions; and (e) a bottom portion at least in part connected to said first and second side portions and said front and back portions.

23. A carton of any size with a pour spout according to claim 22, wherein said glue flap portion is in the range of 30% to 70% of the width of said outer flap portion.

24. A carton of any size with a pour spout according to claim 23, wherein said pull tab means is releasably attached to said glue flap.

25. A carton of any size with a pour spout according to claim 24, wherein said trough shaped bottom of said orifice has a flat bottom portion, first and second angled side portions, and a ledge portion.

26. A carton of any size with a pour spout according to claim 25, wherein the top of said orifice cover is located approximately 0.25 inches from said connection between said top portion and said first side portion.

27. A carton of any size with a pour spout according to claim 26, wherein the width of said orifice and said orifice cover is approximately 0.75 inches.

28. A carton of any size with a pour spout according to claim 27, wherein said first and second angled side walls are at approximately 135° to said flat bottom portion of said trough shaped bottom.

29. A carton of any size with a pour spout according to claim 28, wherein the height of said trough shaped bottom is approximately 0.25 inches.

30. A carton of any size with a pour spout according to claim 29, wherein the width of each said angled side wall is approximately 0.25 inches.

31. A carton of any size with a pour spout according to claim 30, wherein the width of said flat bottom portion of said trough shaped bottom is approximately 0.19 inches.

32. A carton of any size with a pour spout according to claim 31, wherein the width of said ledge portion is approximately 0.06 inches.

* * * * *